United States Patent [19]

Fleissner

[11] Patent Number: 4,912,945

[45] Date of Patent: Apr. 3, 1990

[54] DEVICE FOR THROUGH-FLOW TREATMENT OF FABRIC, PAPER, OR THE LIKE

[75] Inventor: Gerold Fleissner, Chur, Switzerland

[73] Assignee: Fleissner Maschinenfabrik AG, Rebstein, Switzerland

[21] Appl. No.: 355,357

[22] Filed: May 23, 1989

[30] Foreign Application Priority Data

Jun. 24, 1988 [DE] Fed. Rep. of Germany ..... 3821330

[51] Int. Cl.[4] ..... D06B 5/08

[52] U.S. Cl. ..... 68/5 D; 68/158; 68/903; 34/123

[58] Field of Search ..... 68/903, 5 D, 5 E, 158, 68/184; 34/111, 122, 123, 139

[56] References Cited

U.S. PATENT DOCUMENTS

| | | | |
|---|---|---|---|
| 3,276,140 | 10/1966 | Walser et al. | 34/122 X |
| 3,303,576 | 2/1967 | Sisson | 34/122 X |
| 3,752,639 | 8/1973 | Thagarg, Jr. | 34/122 X |
| 3,955,226 | 5/1976 | Feess et al. | 68/903 |
| 4,811,574 | 3/1989 | Fleissner | 68/5 D |

FOREIGN PATENT DOCUMENTS 1460525 11/1970 Fed. Rep. of Germany ..... 68/903

*Primary Examiner*—Philip R. Coe

*Attorney, Agent, or Firm*—Antonelli, Terry & Wands

[57] ABSTRACT

The permeable drum for the wet or dry treatment of textile material, paper, or other permeable materials of a certain width consists solely of narrow sheet metal strips or narrow webs. The sheet metal strips extend axially parallel, their extension in width being oriented in the radial direction. The webs are oriented in the peripheral direction and form parts of the connecting elements between the sheet metal strips, these connecting elements carrying the screen-type cover. The connecting elements, also serving as spacers, are formed of one piece and connect two neighboring sheet metal strips. Connection of the spacers with the sheet metal strips is achieved by headless screws. The proximate ends of the two screws succeeding each other in the peripheral direction are threaded into a nut which latter, in turn, can be encompassed by a fitting connecting element. While the web of the connecting elements is in each case fashioned to be narrow, the base should be broader in order to provide a good seal for the peripheral region of the drum that is not under a suction draft.

6 Claims, 1 Drawing Sheet

DEVICE FOR THROUGH-FLOW TREATMENT OF FABRIC, PAPER, OR THE LIKE

This invention relates to an apparatus for the flow-through treatment of textile material, nonwovens, or paper, with a gaseous or liquid treatment medium circulated in the entire apparatus, comprising a permeable drum subjected to throughflow from the outside toward the inside, the drum being under a suction draft and having end plates at the end faces and serving as a conveying element, the drum being covered on its periphery with a screen-type cover, sheet metal strips extending in the axial direction being arranged between the end plates of the drum, the extension in width of these sheet metal strips running substantially in the radial direction, and connecting elements which connect the sheet metal strips being provided in the peripheral direction between the sheet metal strips; these connecting elements (a) being in each case made of one piece;

(b) having a width corresponding to the desired spacing of the directly adjacent sheet metal strips; and (c) being firmly connected on both sides with the adjoining sheet metal strips; and (d) being provided, over its length (in the peripheral direction of the drum), with a transverse bore through which an elongated threaded member, e.g. a bolt or screw can be passed and can be connected by means of a nut with adjacent sheet metal strips; said nut being of sufficient length to serve as a spacer element between adjacent metal strips.

The invention is based on the object of finding a drum structure abandoning the conventional honeycomb structure and rather utilizing readily mountable spacers between the sheet metal strips which, however, are to be designed additionally so that a weld joint can be avoided and yet optimum permeability of up to 90% is obtained for the fluid flowing therethrough. In supplementation of this object, the condition is furthermore to be ensured that, between each of the connecting elements, equally high strength is ensured regarding the drum structure; in particular, the screws for fixing the connecting elements in place are not to give rise to imbalances at the drum periphery but rather the stabilization of the sheet metal strips around the drum is to be uniform.

In order to attain this object, the invention in a development of the apparatus according to DE-A- 38 02 791.7 and corresponding U.S. Pat. No. 4,811,574, provides that the screwhead and the adjacent screw nut between two neighboring sheet metal strips are integrated into a one-piece nut having a length equal to the spacing between adjacent metal strips. Consequently, the conventional elongated threaded members, e.g. bolts thus do not exhibit an ordinary screwhead but rather each member is provided with a threaded portion at each end and is screwed into the nut of the associated belt following in the peripheral direction. As a consequence, the drum shows the same strength over the entire jacket surface at each connecting element although there is no welded structure present; rather, the drum contains several individual elongated threaded members or elements.

The connection according to this invention is even more advantageous if the nuts are arranged within a modified connecting element so that a web holding the sieve netting is also present at the threaded connections sites.

One embodiment of the apparatus according to this invention is illustrated in the accompanying drawings wherein.

Figure 1:
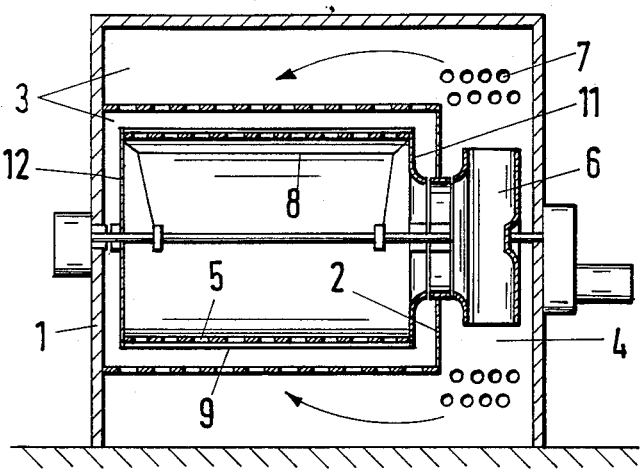
FIG. 1 shows a section view of a sieve drum drying device, the drum jacket of which, however, is not perforated but is made up of a sheet metal strip structure.

The drum unit according to FIG. 1 consists of a rectangular housing 1 subdivided by a partition 2 into a treatment chamber 3 and a fan chamber 4. In the treatment chamber 3, a drum 5 is rotatably supported and, concentrically thereto, a fan 6 is rotatably mounted in the fan chamber 4. The fan chamber can, of course, also be arranged in a segregated, separate fan housing, not shown herein. In any event, the fan places the interior of the drum 5 under a suction draft by way of its open end face. The present invention likewise relates to the drum construction in connection with a wet treatment device which can also serve merely for suction removal of liquid. The total structure then must be adapted correspondingly.

According to FIG. 1, heating units 7 are, respectively, located above and below the fan 6; these heating units consist of pipes traversed by a heating medium. In general, the drums of the structure here of interest, which structure is up to 90% air-permeable, are built with a very large diameter, and the drum is covered during the heat treatment with the textile material or paper over almost the entire peripheral surface area. In the zone of the feeding and removing of the textile material or paper, the drum is to be shielded, however, from the inside against the inwardly prevailing suction draft; for this reason, FIG. 1 shows the inner protective cover 8. However, in this embodiment, the inner protective cover could also be fixedly mounted at the level of the drum axis. On the outside, a fine-mesh screen 9 is wrapped around the drum structure and is attached at the end faces of the drum to the two end plates 11, 12.

Figure 2:
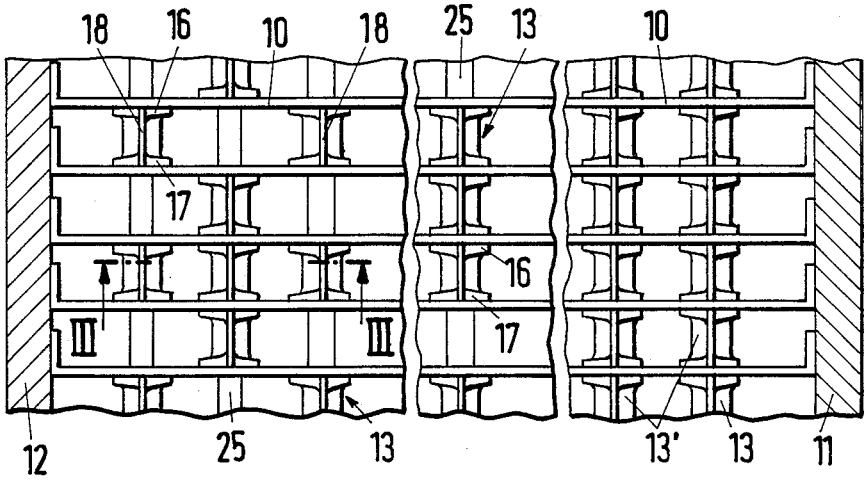
FIG. 2 shows in an enlarged view from the top the sheet metal strip structure of the drum jacket.

The drum structure can be seen in a top view in FIG. 2. The drum structure consists of axially aligned sheet metal strips 10; the extension in width of each can be seen from FIG. 3 and runs essentially in the radial direction. Therefore, the screen-type cover 9 rests initially only on the edges of the sheet metal strips 10 that are located radially on the outside. The sheet metal strips 10 are attached at a defined distance side-by-side to the two end plates 11, 12 by means of screws bolts or rivets. In order to maintain this distance over the width of the drum 5 when the respectively to be treated textile material, paper, or the like is applied, connecting elements are provided, denoted in their entirely by reference numeral 13 and serving as spacer means; these connecting elements are joined to the sheet metal strips 10 by means of elongated threaded member, e.g. bolts 23, 24. The connecting elements 13 have an approximately double-T configuration according to FIG. 2. This cross-section results from the necessary, firm contact of the connecting elements 13 with the sheet metal strips 10. The double-T cross section results in a total structure of the drum which is more rugged and presents greater rigidity against twisting. The connecting elements, however, are not designed with the flanges 16, 17 over their entire height, but only in the zone of the bolts 23, 24 penetrating the connecting elements, as can be seen from FIG. 3. The radially outwardly located regions of the respective connecting element consist merely of the narrow web 18 on which then the screen-type cover 9 is additionally resting—besides the sheet metal strips 10. The result is a merely extremely small total contact surface area, namely 10% of the entire peripheral surface area of the drum. Consequently, the drum jacket surface is 90% air-permeable. Even though the cross-section of the connecting elements increases radially inwardly, this merely results in an increase in air flow in the space between the elements constituting the drum structure. This, however, has not effect on the air permeability of the drum and has no significance for the throughflow action, i.e. for the treatment of the respectively applied material.

Figure 3:
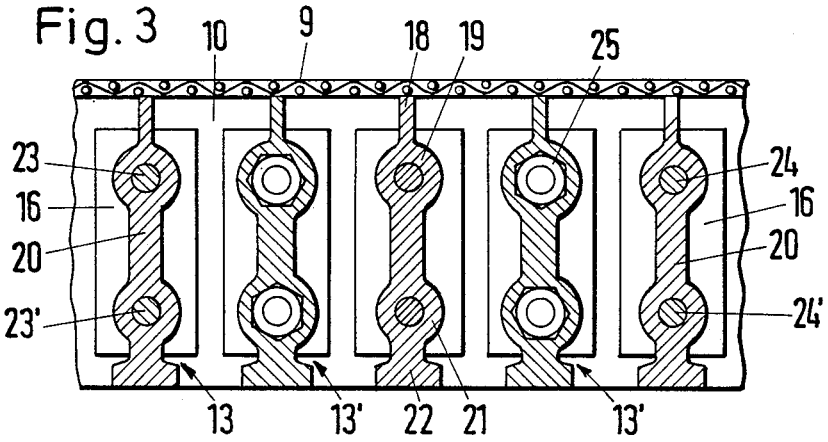
FIG. 3 furthermore shows in an enlarged view a section along line III—III of FIG. 2.

FIG. 3 shows the radial cross-section of the connecting elements 13. The cross-section of double-T shape according to FIG. 2 can be derived from FIG. 3 by the rectangular flange 16. This flange neither extends to the radially outward nor up to the radially inward edge of the sheet metal strip 10. The connecting element 13 is, in total, fashioned to be very thin, namely only solid enough to attain the required strength and to provide adequate support for the bolts 23, 23', 24, 24' penetrating the connecting element 13. The thickness of the material in the zone of the screen-type cover 9 is extremely thin on account of the web 18. A tubular section 19 follows thereafter, for accommodating the first bolt 23, 24. Further radially inwardly, a wall 20 is provided up to the subsequent bolt 23', 24'; this wall is designed to be narrower in crosssection for weight considerations. There then follows the tubular section 21 for the bolt 23', 24', and adjoining thereto is the base 22 of the connecting element 13 extending up to the radially inwardly located edge of the sheet metal strip 10. This base 22, in turn, is fashioned to be somewhat broader to provide adequate sealing of the air-permeable and air-impermeable parts with the aid of the inner cover 8.

A screw or bolt consists normally of an integrated screwhead and—on the other end—of a threaded shaft for receiving a screw nut. This feature, in the above-described drum structure, causes weakening of the drum construction, of the mounting of the sheet metal strips in the proximate zone of these screwheads and, respectively, adjacent screw nuts. Furthermore, different centrifugal forces are effective at the screwhead and the screw nut which may cause an imbalance of the drum. In order to avoid all of these disadvantages, only headless bolts or threaded "rods" 23, 23'; 24, 24' with the threads at both ends of the rods and associated nuts 25 are employed in accordance with this invention, these nuts connecting respectively two of these "rods" arranged in a line in series. The novel nuts 25 should be of the same length as a connecting element 13, thus replacing such a connecting element at least with respect to spacing. It is advantageous for the screw ends to contact each other within the respective nut 25. If necessary, spacer shims are to be introduced into the nuts.

It is especially advantageous to have the nuts 25 encompassed by a modified connecting element 13'. During assembly, the nuts are thus threaded to the screw ends and tightened. Subsequently, the special modified connecting elements 13' are placed on the nuts 25, a further "rod" or elongated member 23, 23'; 24, 24' is threaded into the nut 25 up to the end, and then the further sheet metal strips 10 plus connecting elements 13 are placed in series. Finally, the drum then has the appearance as illustrated in FIG. 2, right-hand detail. Consequently, mounting elements all around the drum can no longer be recognized.

What is claimed is:

1. An apparatus for the flow-through treatment of textile material, nonwovens, or paper, with a gaseous or liquid treatment medium comprising a permeable drum subjected to throughflow of the treatment medium from the outside toward the inside, said drum being under a suction draft and having end plates at end faces and serving as a conveying element and said drum being covered on its periphery with a screen-type cover, sheet metal strips extending in the axial direction of the drum and being arranged between the end plates of the drum, an extension in width of said sheet metal strips running substantially in the radial direction, and connecting elements which connect the sheet metal strips being provided in the peripheral direction between the sheet metal strips;

(a) said connecting elements each being a one-piece element;

(b) said connecting elements each having a width corresponding to the desired spacing of the directly adjacent sheet metal strips;

(c) said connecting elements being firmly connected on both sides with the adjoining sheet metal strips; and (d) each connecting element being provided, over its length (in the peripheral direction of the drum), with a transverse bore through which an elongated threaded member is be passed and is connected by means of a nut with adjacent sheet metal strips, characterized in that the elongated threaded member is free of a screwhead and the neighboring nut between two adjacent sheet metal strips is an elongated one-piece internally threaded element to allow engagement with two aligned elongated threaded members.

2. An apparatus according to claim 1, characterized in that two threaded members arranged in a line in series are joined together by means of only one elongated internally threaded element, said element comprising a nut.

3. An apparatus according to claim 1 or 2, characterized in that the elongated internally threaded element corresponds in its length to that of one connecting element.

4. An apparatus according to claim 3, characterized in that a plurality of elongated threaded members joining the connecting elements to the sheet metal strips are arranged without interruption in a line all around the drum.

5. An apparatus according to claim 1, characterized in that the elongated threaded members contact each other within the elongated internally threaded element.

6. An apparatus according to claim 1, characterized in that the elongated internally threaded elements comprise nuts that are located within a modified connecting element.

* * * * *